US006497739B2

(12) United States Patent
McGill

(10) Patent No.: US 6,497,739 B2
(45) Date of Patent: Dec. 24, 2002

(54) MODULAR CLEAN ROOM FILTER SYSTEM

(76) Inventor: Joseph A. McGill, 3310 E. Yorba Linda Blvd., #425, Fullerton, CA (US) 92831

( * ) Notice: Subject to any disclaimer, the term of this patent is extended or adjusted under 35 U.S.C. 154(b) by 0 days.

(21) Appl. No.: 09/889,027

(22) PCT Filed: Jan. 3, 2001

(86) PCT No.: PCT/US01/00083

§ 371 (c)(1),
(2), (4) Date: Jul. 6, 2001

(87) PCT Pub. No.: WO02/05385

PCT Pub. Date: Jul. 11, 2002

(65) Prior Publication Data

US 2002/0134061 A1 Sep. 26, 2002

(51) Int. Cl.[7] ..... B01D 46/42; E04B 9/02

(52) U.S. Cl. ..... 55/385.2; 55/DIG. 29; 55/DIG. 31; 454/187; 454/293; 454/294

(58) Field of Search ..... 55/385.1, 385.2, 55/DIG. 29, DIG. 31; 454/187, 294, 293

(56) References Cited

U.S. PATENT DOCUMENTS 3,986,850 A * 10/1976 Wilcox ..... 55/385.2
4,088,463 A * 5/1978 Smith ..... 55/385.2
4,671,811 A * 6/1987 Cadwell, Jr. et al. ..... 55/385.2
4,849,862 A * 7/1989 Diskin et al. ..... 55/385.2
4,883,511 A * 11/1989 Gustin et al. ..... 55/385.2
5,279,632 A * 1/1994 Decker et al. ..... 55/385.2
5,329,739 A 7/1994 Madl, Jr.
5,364,425 A * 11/1994 Simon et al. ..... 55/385.2
5,613,759 A * 3/1997 Ludwig et al. ..... 55/385.2
5,865,674 A * 2/1999 Starr ..... 55/385.2
5,871,556 A 2/1999 Jeanseau et al.
5,958,114 A * 9/1999 Sunahara et al. ..... 55/385.2
6,371,846 B1 * 4/2002 Powell et al. ..... 55/385.2

* cited by examiner

*Primary Examiner*—David A. Simmons
*Assistant Examiner*—Minh-Chau T. Pham
(74) *Attorney, Agent, or Firm*—James G. O'Neill

(57) ABSTRACT

An air filter system for a clean room has a number of filter modules (16) secured together at intersecting corners by holding rods (12) secured to a supporting surface, and at least one support bracket (14, 14', 14") on each holding rod. The filter modules include top panels (18, 18'), that, if separable, are secured to upper supporting brackets and a filter element (19) having a rigid frame (21) and filter panels (27) held therein secured to lower brackets. Light fixtures (38) may be secured to center divider (40) held in the filter frames and diffuser panels (50) or aerodynamically-shaped elements (60) may be secured to the support brackets, below the filter elements.

20 Claims, 8 Drawing Sheets

MODULAR CLEAN ROOM FILTER SYSTEM

FIELD OF THE INVENTION

This invention relates generally to air filter support systems, and more particularly, to modular air filter systems for clean rooms wherein the number of particles in the air must be minimized.

DESCRIPTION OF RELATED ART

Clean rooms are commonly used in many industries, such as the electronic, medical and pharmaceutical industries, to reduce the number of particles in the air to specified limitations. In the most common approach, a layer of flat filters is suspended from a room ceiling or a sidewall, with the filters extending over the entire area of the ceiling or sidewall. The air is conducted from a plenum through the filters into an open space in the room and then returned back to the plenum by way of outlets in the room. The filter elements are normally supported by supporting elements, such as a grid, which engages the entire peripheral frame of each filter element. In addition, it is necessary to have an air-sealing gasket or sealing gel positioned between the grid elements and the filter panel frames. Because the known grid support systems do not always work efficiently, numerous attempts have been made to provide improved filter systems and/or support systems for clean rooms.

In U.S. Pat. No. 5,329,739 to Madl, Jr., there is described a clean room filter system in which clusters of four filter units are support together at the intersection of respective corners by a rotatable disk overlapping each corner. Each disk is suspended from a support surface, such as a ceiling, and includes holes which are alignable with holes in the frames at the four corners, whereby vertical positioning pins may be threaded into the supporting disk and entered into respective corners of the filter panels to hold the filter panels in place. The vertical positioning pins are retracted when a disk is to be rotated, and a pie-shaped cut-out portion formed in the disk is aligned with a filter panel corner so that the filter panel may be inserted or removed from the plane of the remaining filter panels without disturbing any of the adjacent filter panels. The positioning pins are reinserted when the disk is returned to its full support position, with the openings in the disk aligned with the openings in the filter panel frames. Gel sealant carried on sealing strips seals the filter units against unfiltered air leakage.

U.S. Pat. No. 5,871,556 to Jeanseau et al. discloses a clean room ceiling in which individual filter units are suspended solely by unshared suspension assemblies so as to be self supporting and readily installable and removable individually and free of grids and other multiple unit supporting expedients. The unshared suspension assemblies are mounted centrally of each filter unit between separate filter packs on each side of a divider.

However, it is still desirable to provide improved and simplified filter support systems for clean rooms.

SUMMARY OF THE INVENTION

The pre sent invention provides clean room filter support systems that may be used in a ceiling or sidewall, and which are less cosutly, better performing and faster to install. The present invention provides more flexible support systems than any currently available, and includes a plurality of individual filter modules, each complete unto itself, including an upper housing or lid panel that may be separable, a volume control or shut off damper, and framed filter elements or panels. Additionally, light fixtures and diffuser panels, or airfoil frame means may be added. The present invention includes a plurality of spaced support members that are suspended from a ceiling or other supporting surface, so as to support corners of individual filter modules where they meet at a corner, at an intersection, or at a wall. Each supporting element includes a support rod and one or more unique support brackets for laterally supporting a filter module, with or without separable lid panels, or a blower housing. Each filter module includes a filter frame that is sufficiently rigid, so as to support filter panels therein when a series of filter modules we secured together in the unique supporting brackets. Each filter module is independently supported at least at the bottom, and can be installed or removed from within the room, without effecting adjacent filter modules.

Filter modules of the present invention can have integrated or separable lid panels, and/or be of the ducted filter-type, fan powered filter-type, or pressure plenum-type. All variations may be interchanged or mixed within a ceiling filter system of the present invention. The top surface or lid panel of each filter module, whether ducted, fan powered, or directly connected to a pressure plenum, may be independent of or separable from the filter element, and installed prior to the filter element. When separable lid panels are used they form a barrier between the clean room space below and the plenum space above. Due to the use of these separable lid panels, the amount of time needed to achieve isolation of the clean space in the room is less than with other known filter systems.

Supply air duct work for the ducted filter module variation is attached directly to the upper side of the lid panel of each module, thus making the duct connection independent of the filter element in the module when the separable lid panel option is used. Preferably, each ducted filter module lid panel includes a damper at the supply duct connection to vary the volume of supply air for balancing and fine-tuning. When the entire filter assembly or module is complete, the rigidly fastened separable lid panels make the entire system a structural diaphragm, thereby reducing the need for further seismic supports. Each of the filter modules may be inserted and removed from within the room, while the system remains in operation by merely shutting off one or more individual modules by use of the dampers.

Gaps between adjacent separable lid panels and/or filter modules are sealed. And, joints between separable lid panels and filter elements are sealed with gaskets or gel sealants.

It is, therefore, a general object of the present invention to provide an improved and simplified air filter system for a clean room. It is a particular object of the present invention to provide an improved and simplified clean room air filter system comprised of individual modules. It is another particular object of the present invention to provide an improved and simplified clean room air filter system comprised of separate filter modules having separable lid panels and filter elements. It is yet another particular object of the present invention to provide an improved and simplified clean room air filter system which utilizes support rods suspended from an overhead ceiling, or other support structure, having one or more spaced support brackets thereon to which filter modules, and/or separable lid panels, or blower housings and filter elements are laterally secured.

These and other objects of the present invention are achieved by providing an air filter system having a plurality of filter modules supported by a plurality of spaced support rods secured to a ceiling or other support surface, with one or more support brackets mounted on each support rod. Each filter module includes a lid panel, which may or may not be separable, having means for allowing air to be blown from an air supply system therethrough. Filter elements, having rigid frames with filter panels held therein, are held in the lid panels and laterally secured to the support brackets. When the lid panels are separable they are supported at their corners by separate support brackets held in upper positions on four spaced support rods, while the separable lid panels have filter elements inserted below each lid panel. The separable lid panels are laterally secured to upper support brackets, while the filter elements are laterally secured to lower support brackets, on each of the four support rods. Adjacent lid panels and filter elements are mounted in the same way to form an air filter system. In one embodiment of the invention, lights are secured to the filter element and diffuser panels are secured below the lights by arms secured to lower brackets on the support rods. Or, the filter frames may include shaped lower edges to close the lower joint between adjacent filter modules.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified modular air filter system, generally indicated at 10, throughout the several views.

Turning now to the drawings, a preferred embodiment of a modular air filter ceiling system of the present invention will be described in connection with FIGS. 1 through 5 and 8. However, it is to be understood that the air filter system of the present invention could also be mounted on a sidewall.

Figure 1:
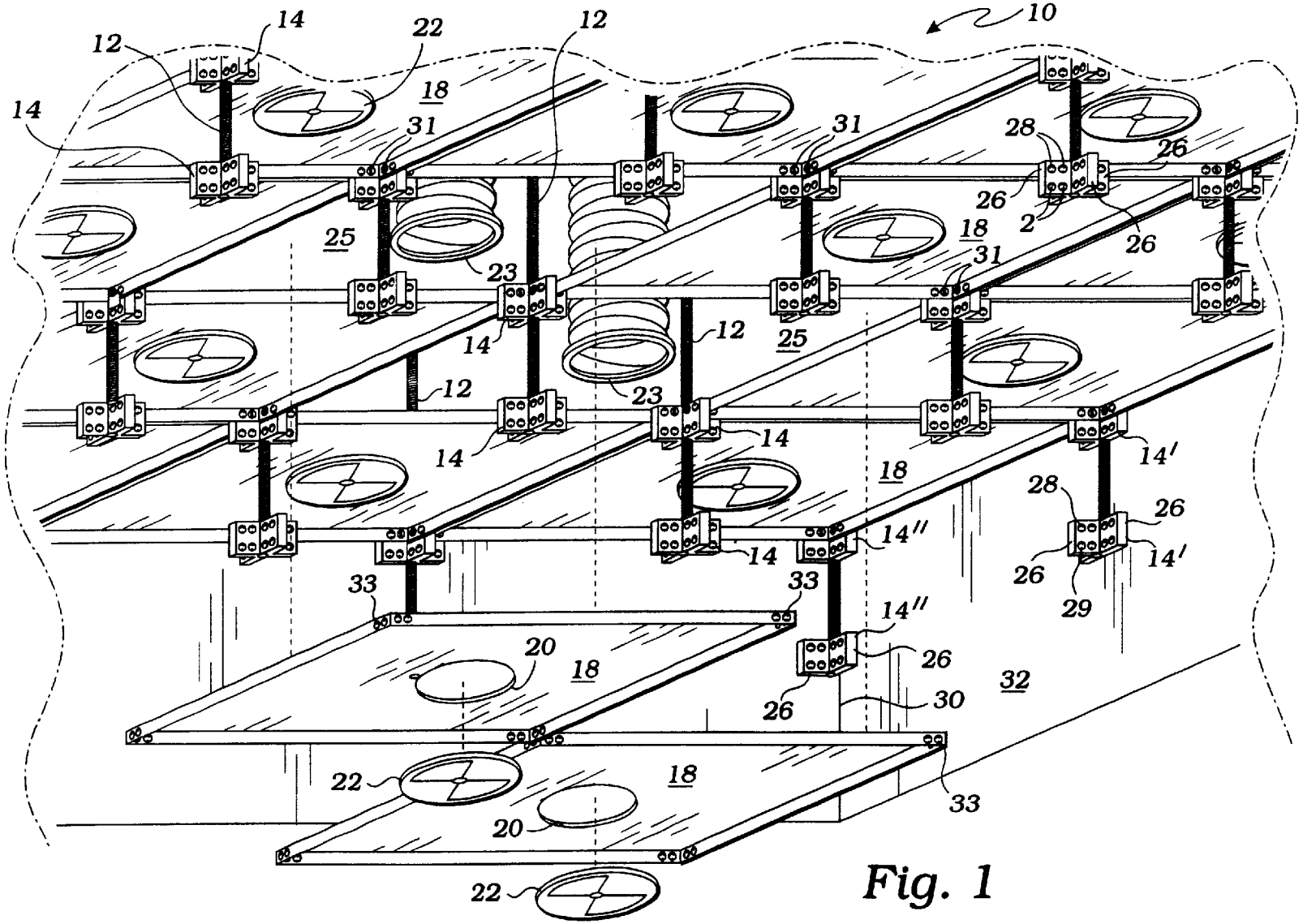
FIG. 1 is a partial perspective view, partially exploded, showing a plurality of supporting rods and support brackets hung from a support surface and having a plurality of separable lid panels secured in upper support brackets.
Figure 6:
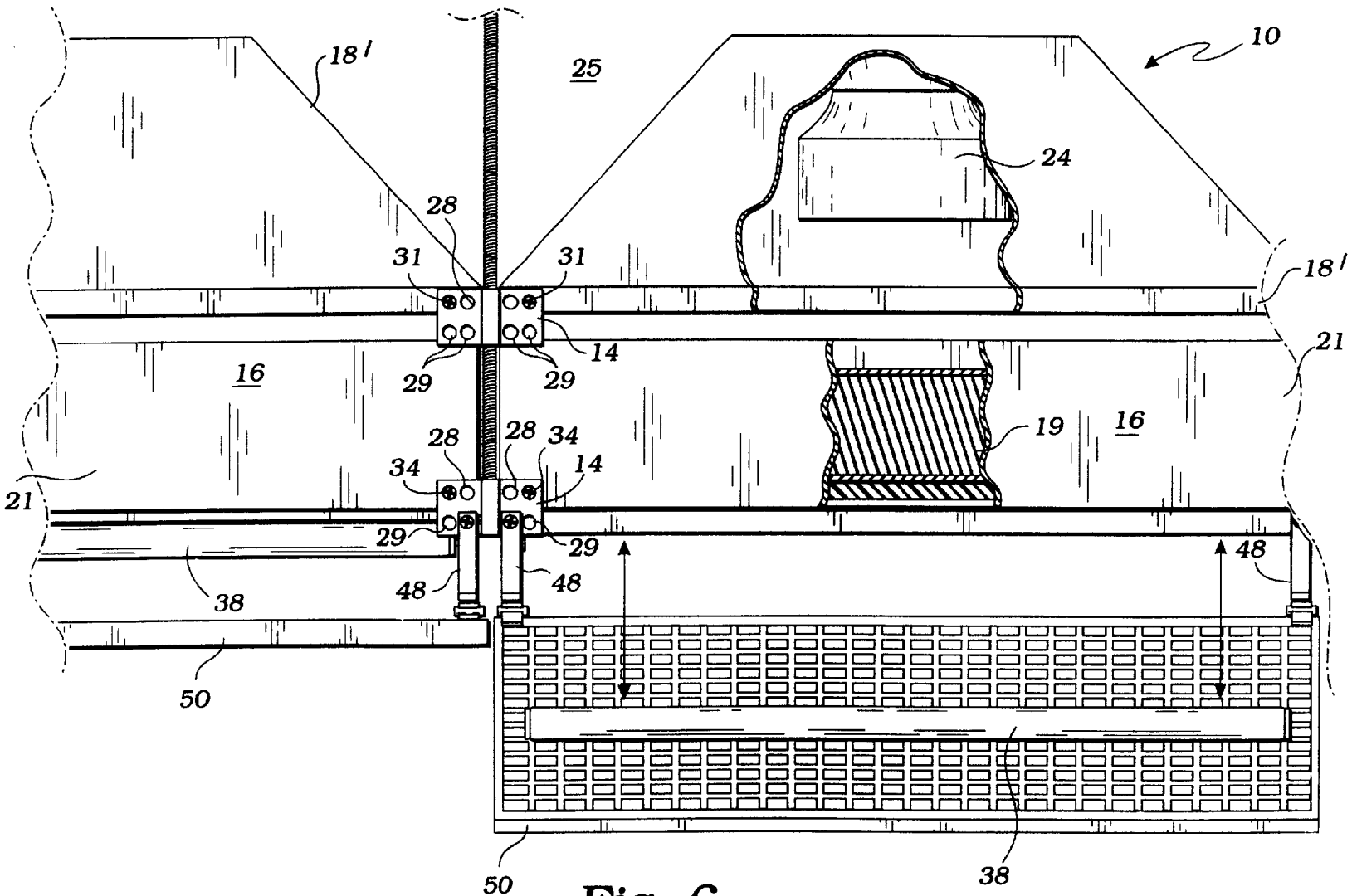
FIG. 6 is a further enlarged sectional view, similar to that of FIG. 5 showing a fan-powered lid housing or panel.
Figure 9:
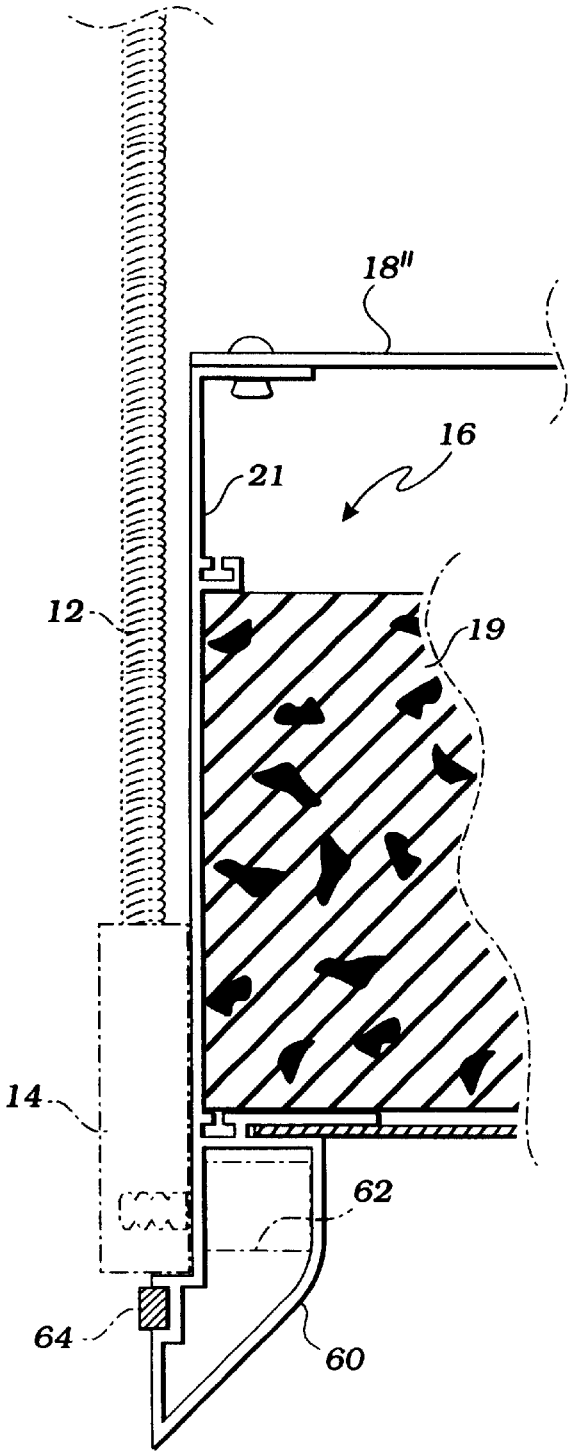
Figure 10:
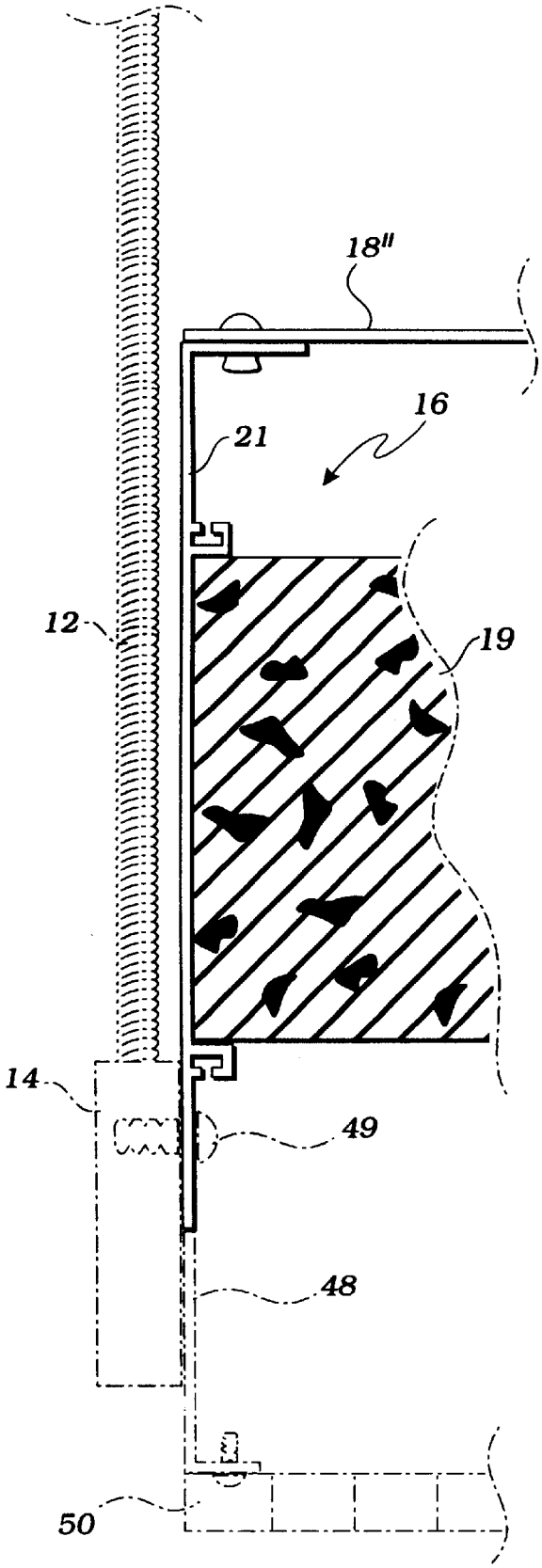

Turning first to FIG. 1, there shown is a portion of an overhead modular filter system 10, having a plurality of spaced apart, threaded support rods 12, holding one or more support brackets 14 thereon. For reasons of explanation only, but not by way of limitation, the support rods 12 are shown having spaced upper and lower support brackets 14. The support brackets 14 may be different or identical, but are referred to as upper and lower support brackets for convenience. The rods 12 are supported from a ceiling, or other support structure, and spaced apart so as to support adjacent filter modules 16 by support brackets 14 at each corner thereof. Each filter module 16 consists of a top lid or panel 18, preferably made from metal, and a filter element 19. The top panels 18 may be separable as shown in FIG. 1, or non-separable as shown in FIGS. 9 and 10. Each lid panel 18 preferably includes a central opening 20 for airflow from ducts 23 in an interstitial space 25. The openings 20 preferably include dampers 22 to control the flow of air from the air ducts 23 or plenum 25 above the top panels 18. In a further embodiment, top panels 18 may be replaced by angled top panels or blower housings 18' having a fan 24 therein, as shown in FIG. 6.

Each of the support brackets 14 include a plurality of arms 26 extending at 90° to each other, with two or more spaced openings 28, 29, formed in each arm. As shown in FIG. 1, when a bracket 14" is mounted in a corner 30, only two arms 26 are required, or if a bracket 14' is mounted against a wall 32, only three arms are needed.

Figure 2:
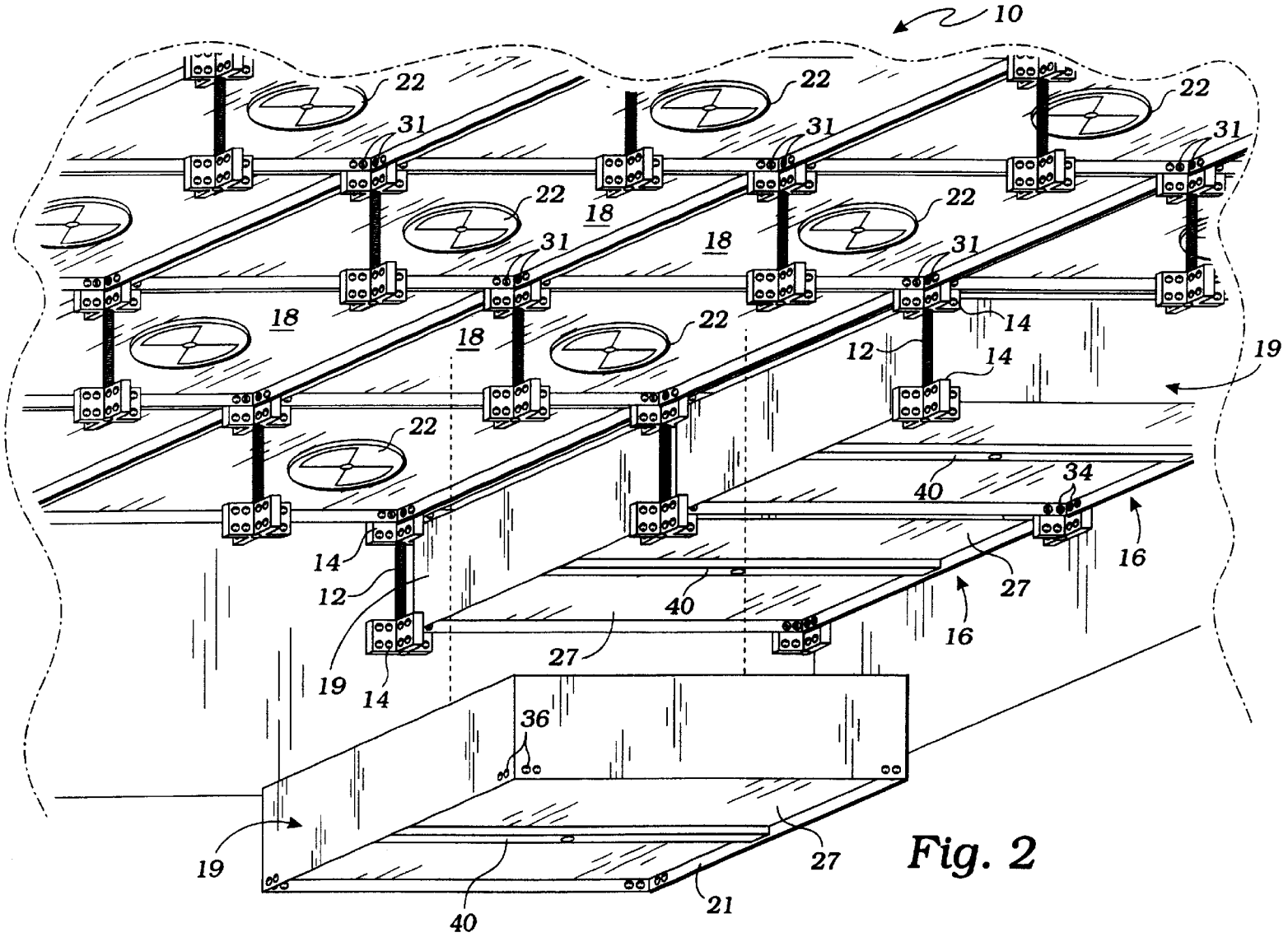
FIG. 2 is a further partial perspective view showing the plurality of separable lid panels in position supported by upper support brackets on support rods and further showing two filter elements secured in position, under separable lid panels, and a third filter element in position to be inserted under a further separable lid panel.

As shown in FIG. 2, the filter elements 19 that are mounted below separable lid panels 18 include exterior frames 21, preferably made from metal, having a filter media or filter panels 27, separated by a divider 40. A plurality of separable top panels 18 or 18' are first secured in place by attaching the same laterally, to one of the openings 28 in upper brackets 14, 14' or 14", at each corner thereof, as by means of securing elements 31, such as pins, screws, or the like, inserted through one aligned corner opening 33 in each corner of each top panel (see FIGS. 1 and 2). After the separable top panels 18 are secured in place on upper brackets 14, 14', 14", over the entire area, or after at least one separable top panel is secured in place, a filter element 19 is then secured in place, by being laterally secured in lower brackets 14, under the lid panel or panels 18. Further securing elements 34, are inserted laterally through openings 36 formed in each corner of a lower edge of the filter frame 21 into upper holes in lower bracket 14, 14', 14" (see FIG. 2).

Figure 3:
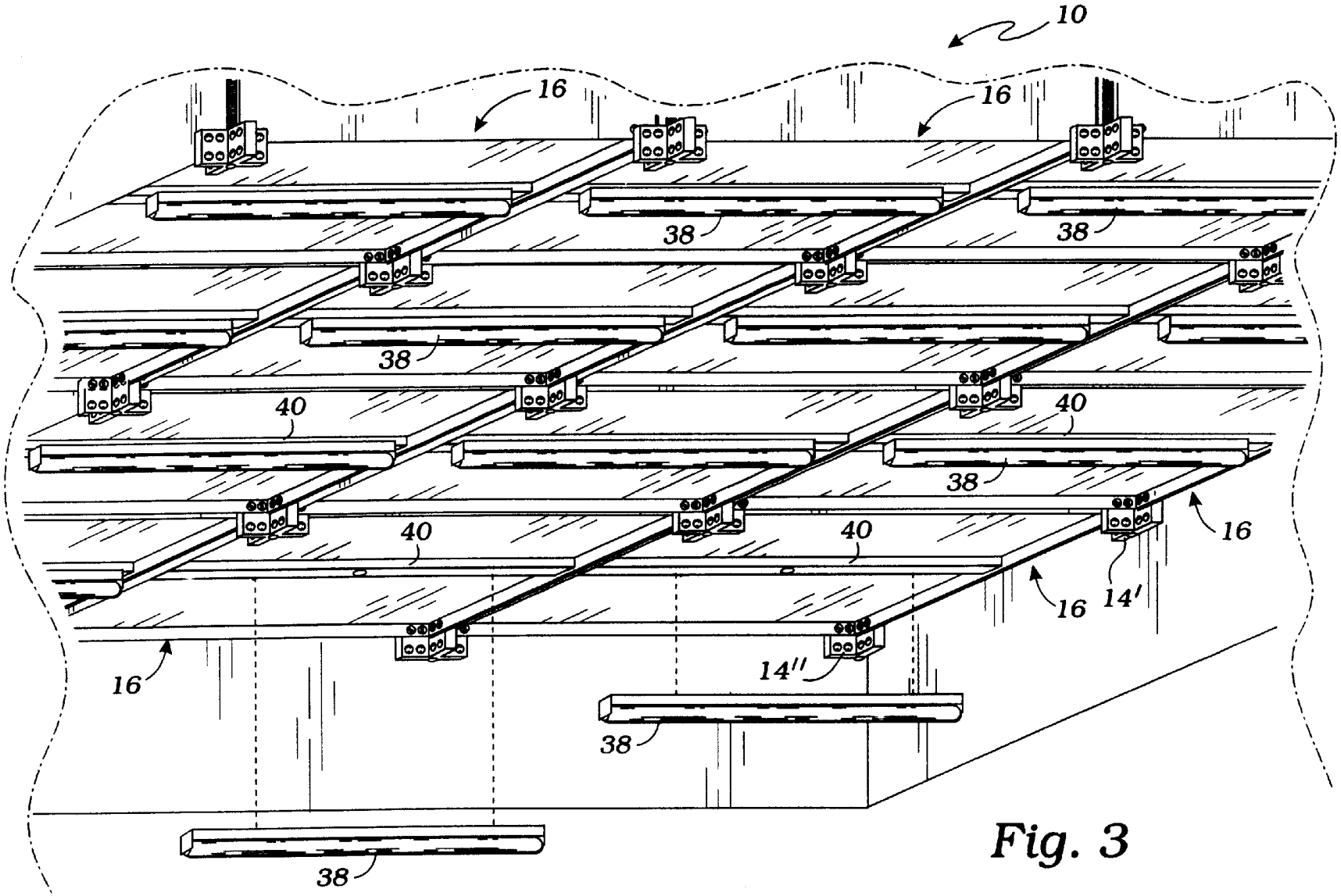
FIG. 3 is a further partial perspective view showing an air filter system of the present invention with all of the filter elements and/or modules in place, and a plurality of lights inserted, or to be inserted, in position below the filter elements and/or modules.

As shown in FIG. 3, when the air filter system is complete, light fixtures 38 having tube lights therein may be added to filter modules 19 that are large enough, as by being secured along a bottom flange on center beam or divider 40, separating filter media or packs in each of the filter frames 21. Each light fixture 38 will be electrically connected in a known manner, and each divider 40 includes a centrally disposed aperture or opening 42, through which a tool 44 may be inserted, when a respective light tube is removed from a fixture (see FIG. 5). The tool 44 includes an inner end 46 that cooperates with the damper 22, to allow adjustment of the damper between open and closed positions, to control the flow of air from air ducts 23 or from a pressure plenum through filter panels 19.

One or more separable top plates 18 may be replaced by top plates 18', having fan motors 24 therein (see FIG. 6).

Figure 4:
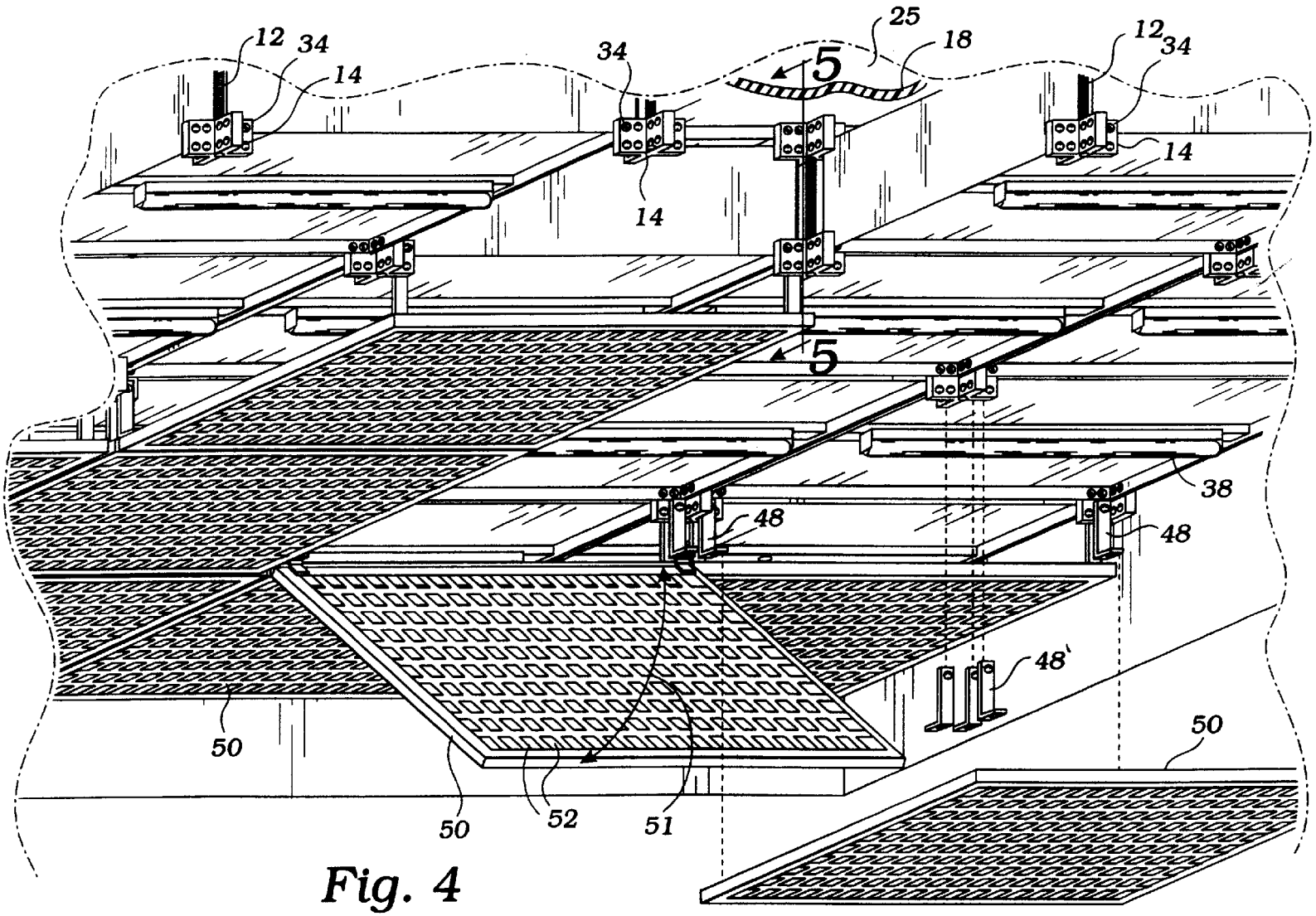
FIG. 4 is a further partial perspective view, showing a plurality of diffuser panels rotatably held below the filter elements and/or modules and lights, as seen from the inside of a clean room.
Figure 5:
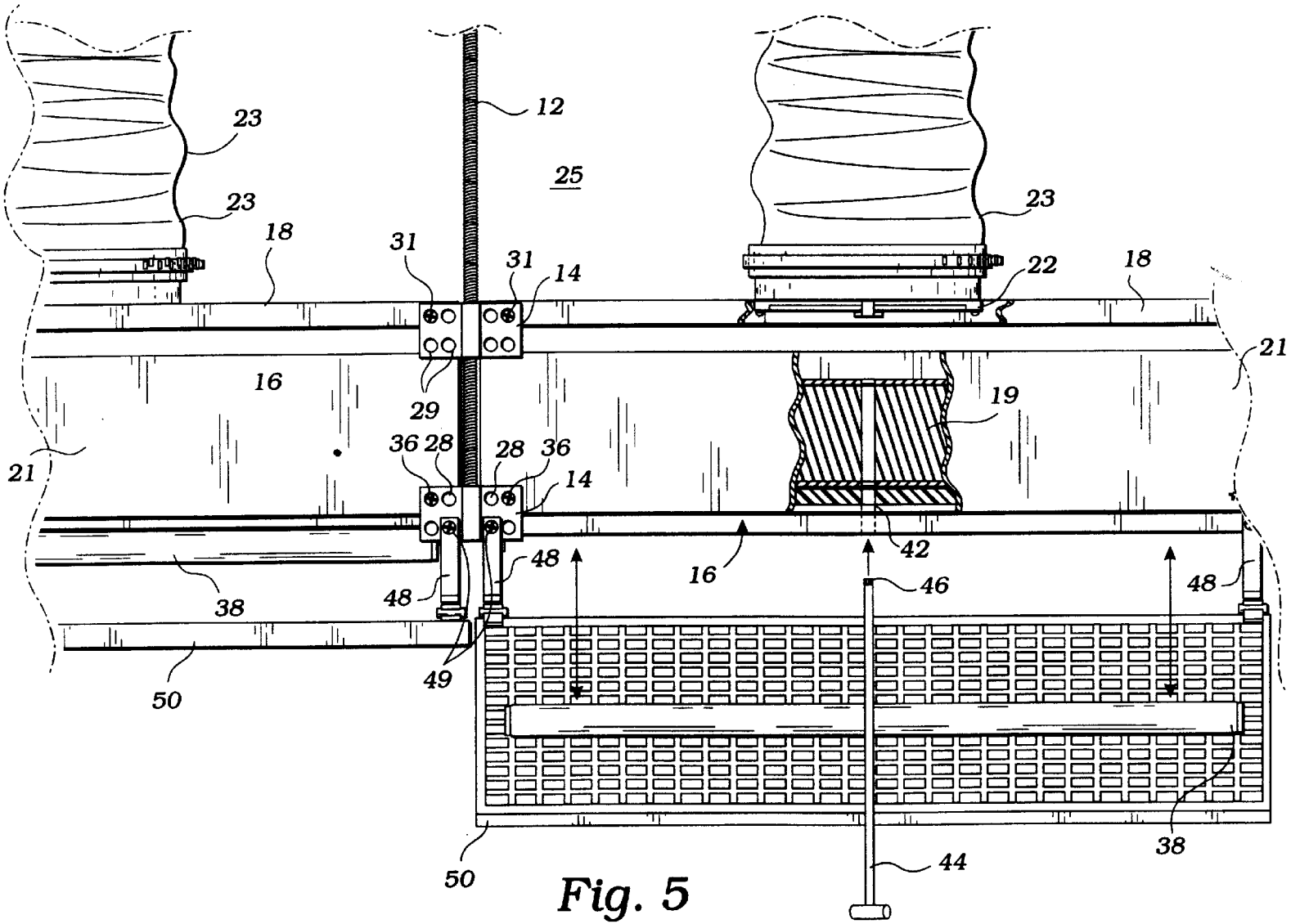
FIG. 5 is an enlarged sectional view, taken along line 5—5 of FIG. 4.

After light fixtures 38 have been added, as shown in FIGS. 4–6, straps or L-shaped element 48 may be added to lower openings 29 in lower brackets 14, as by means of securing elements 49, and diffuser panels 50 secured thereto. The diffuser panels 50 are preferably mounted so as to be rotatable about one end, downwardly, as shown by arrow 51 in FIG. 4. Each of the diffuser panels 50 may be secured in the upper position and includes a plurality of apertures or openings 52 to allow air and light to pass therethrough into the clean space below.

Figure 7:
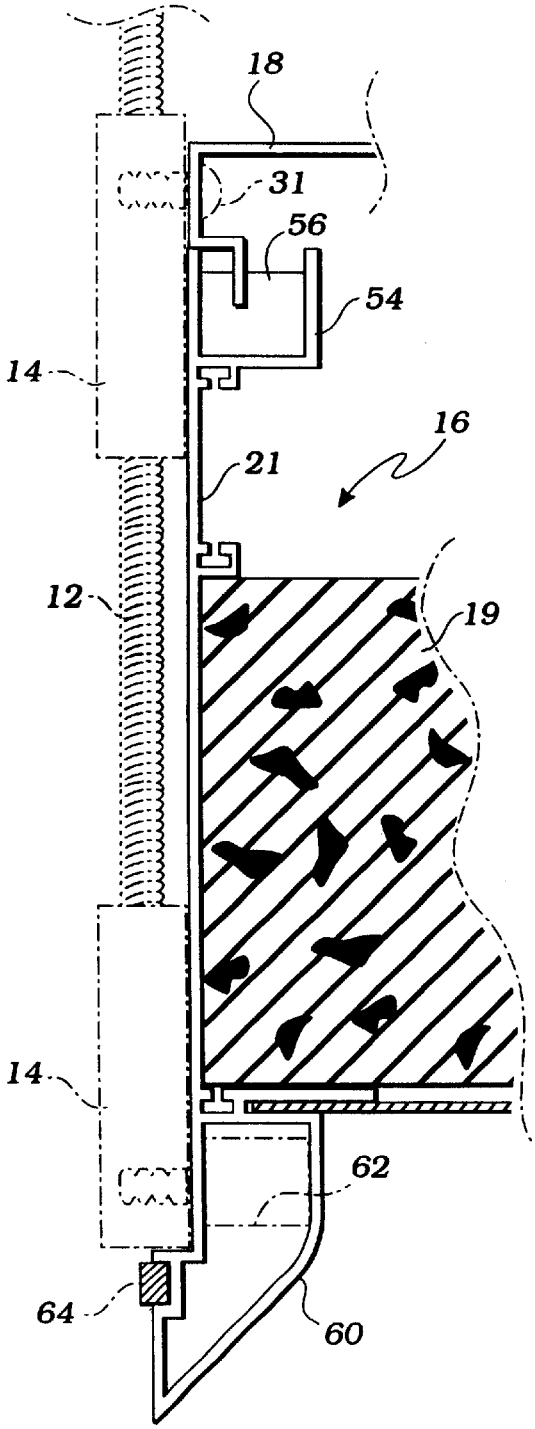
FIGS. 7 through 10 are enlarged sectional views of various types of filter frame sections of the present invention.
Figure 8:
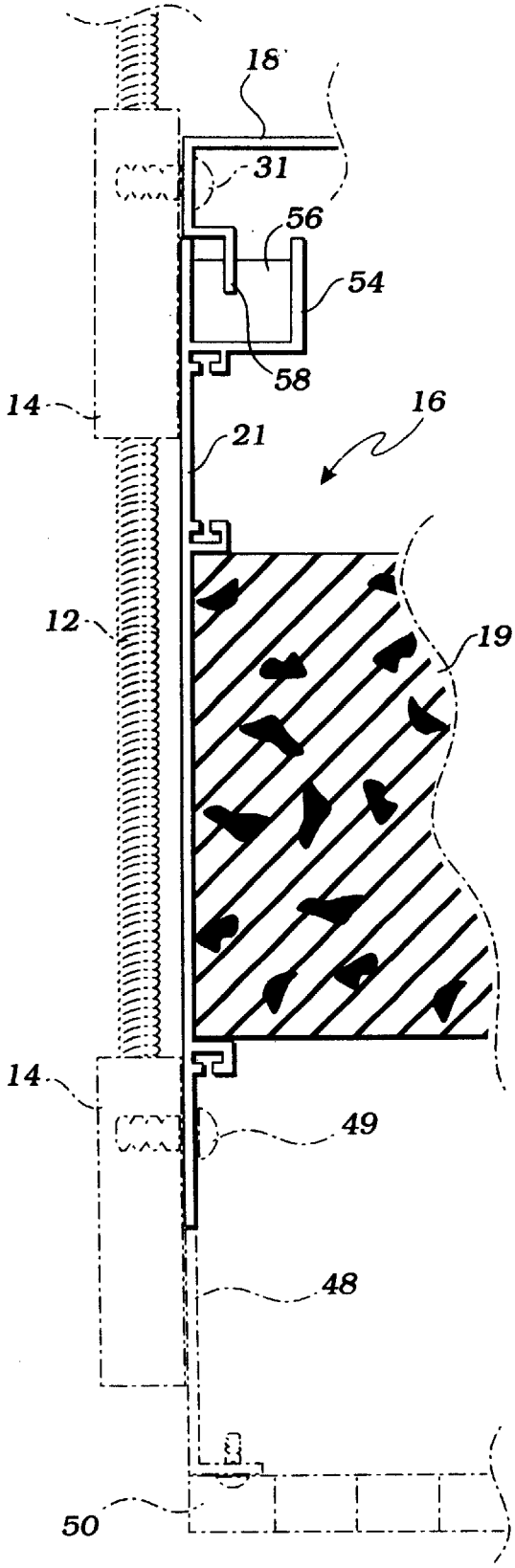

Turning now to FIGS. 7 and 8, the means for sealing the filter modules 16 at the top, will be described. Each of the filter frames 21 includes a top channel or trough 54, formed around its inner, upper peripheral edge. A sealing means 56, such as a gasket or sealing gel is held in the top channel. The top panel 18 includes a lower edge portion 58, preferably inwardly offset, which cooperates with the sealing means 56, to positively seal the upper periphery of each filter module 16 and prevent pressurized air from leaking out of the filter modules. If desired, the diffuser panels 50 and holding straps 48 may be omitted, and aerodynamically-shaped elements or brackets 60 may be formed as a part of or secured to the lower edges of each filter module 16. Securing elements 62 are used to secure adjacent elements 60 to lower brackets. Each element 60 preferably includes a sealing element 64, which will cooperate with a mating sealing element on an adjacent panel, to further seal the space between adjacent filter modules 16.

Turning now to FIGS. 9 and 10, means for attaching non-separable lid panels 18 to the top of the filter frames 21 is illustrated. In these embodiments, no upper support brackets 14 are used, and the top panels 18 are directly connected to the frames 21, as by rivets or the like. The filter modules 16 are only laterally secured to the lower support brackets 14.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A clean room air filter system having a plurality of air filters, comprising:

a supporting surface;

a plurality of separate filter modules supported from the supporting surface;

each of the plurality of separate filter modules including a lid panels a filter frame having a plurality of corners and filter panels held in the filter frame;

a plurality of supporting rods secured to the supporting surface;

at least one supporting bracket secured to each of the plurality of supporting rods, so as to be aligned with the plurality of corners of each filter frame; and securing means laterally extending through the at least one supporting bracket secured to each of the plurality of supporting rods and the plurality of corners of each filter frame for supporting each of the plurality of filter modules and to allow each of the plurality of filter modules to be inserted and removed from the air filter system from inside the clean room.

2. The clean room air filter system of claim 1 wherein the securing means are mechanical elements passing laterally through the plurality of corers of each filter frame into the at least one supporting bracket secured to each of the plurality of supporting rods.

3. The clean room air filter system of claim 1 wherein each lid panel includes an opening therein to allow air to pass through the filter panels into the clean room.

4. The clean room air filter system of claim 3 wherein airflow through the opening in the lid panel is controlled by a damper.

5. The clean room air filter system of claim 2 wherein each lid panel includes an opening therein having a damper to control air flow passing into the filter panels.

6. The clean room air filter system of claim 5, further including a divider secured in the filter frame; the divider including at least one aperture formed therein for insertion of a tool to control opening of the damper.

7. The clean room air filter system of claim 6, further including a light fixture supported on the divider below the filter panels.

8. The clean room air filter system of claim 1, wherein each lid panel is connected to a pressurized air supply.

9. The clean room air filter system of claim 1 wherein at least one lid panel includes a blower assembly therein.

10. The clean room air filter system of claim 1 wherein each lid panel is separable and there are upper and lower supporting brackets on each of the supporting rods, and wherein the upper and lower supporting brackets include arms having spaced openings extending through the arms.

11. The clean room air filter system of claim 1, further including diffuser panels secured to the supporting brackets.

12. The clean room air filter system of claim 1, further including an aerodynamically-shaped element secured along a lower edge of the filter frame.

13. A clean room air filter system having a plurality of filters, comprising:

a supporting surface;

each of the plurality of filters being a separate filter module separately supported from the supporting surface;

each separate filter module having a lid panel, a filter frame with four corners and filter panels held in the filter frame;

each lid panel having an opening to allow air flow therethrough;

a plurality of spaced supporting rods secured to the supporting surface;

at least one supporting bracket secured to each of the supporting rods; and mechanical securing elements for laterally securing the four corners of each filter frame to the at least one supporting bracket secured to each of the supporting rods for laterally supporting each of the filter modules and to allow each of the filter modules to be separately inserted and removed from the air filter system from inside the clean room.

14. The clean room air filter system of claim 13, wherein the mechanical securing elements pass laterally through the four corners of each filter frame into the at least one supporting bracket secured to each of the plurality of supporting rods.

15. The clean room air filter system of claim 14 wherein airflow through the opening in the lid panel is controlled by a damper.

16. The clean room air filter system of claim 15, further including a divider secured in the filter frame; the divider including at least one aperture formed therein for insertion of a tool to control opening of the damper; and wherein each lid panel is connected to a pressurized air supply.

17. The clean room air filter system of claim 16, further including a light fixture supported on the divider below the filter panels.

18. The clean room air filter system of claim 17 wherein each lid panel is separable and there are upper and lower supporting brackets on each of the supporting rods, and wherein the upper and, lower supporting brackets include arms having spaced openings extending through the arms.

19. The clean room air filter system of claim 18, further including diffuser panels secured to a lower end of the supporting brackets, away from the supporting surface.

20. A clean room air filter system having a plurality of filters, comprising:

a clean room having a supporting surface;

each of the plurality of filters being a separate filter module separately supported from the supporting surface;

each separate filter module having a lid panel, a filter frame and filter panels held in the filter frame;

each lid panel having an opening with a damper held therein to control flow of air therethrough;

a plurality of spaced supporting rods secured to the supporting surface;

a pair of supporting brackets secured to each of the plurality of spaced supporting rods; each of the pairs of supporting brackets having arms with spaced openings extending through the arms; and mechanical securing elements for laterally securing the filter module to the spaced openings in the pair of supporting brackets to allow each of the filter modules to be separately inserted and removed from the air filter system from inside the clean room.

* * * * *